United States Patent [19]

Mackel

[11] Patent Number: 4,564,034

[45] Date of Patent: Jan. 14, 1986

[54] NAIL CLIPPER HOLDER

[76] Inventor: Nathaniel T. Mackel, 1510 Mosher St., Apt. 7-A, Baltimore, Md. 21217

[21] Appl. No.: 573,016

[22] Filed: Jan. 23, 1984

[51] Int. Cl.[4] ..... A45D 29/00

[52] U.S. Cl. ..... 132/73; 132/1 R; 132/76.5

[58] Field of Search ..... 132/73, 73.5, 76.5, 132/84 D, 90; 211/69.1, 69.5, 60.1, 70.6, 70.7; 206/349; 30/28, 124, 296, 231; 269/289 R, 303

[56] References Cited

U.S. PATENT DOCUMENTS

| | | | |
|---|---|---|---|
| 1,472,820 | 11/1923 | White | 211/69.5 |
| 2,219,597 | 10/1940 | Lutz | 132/73 |
| 2,386,500 | 10/1945 | Parker | 211/69.1 |
| 2,467,589 | 4/1949 | Johansson | 30/124 |
| 3,180,025 | 4/1965 | Tsunemi | 30/28 |
| 3,712,311 | 1/1973 | Hedu | 132/73 |
| 3,855,698 | 12/1974 | Crosby | 30/124 |
| 3,903,596 | 9/1975 | Crosby | 30/29 |
| 3,943,948 | 3/1976 | Sartore | 132/72 |
| 4,121,719 | 10/1978 | Wilhelm | 211/69.5 |
| 4,341,015 | 7/1982 | Young | 30/28 |
| 4,412,618 | 11/1983 | La Conte | 211/70.6 |

*Primary Examiner*—Gene Mancene
*Assistant Examiner*—Carolyn A. Harrison
*Attorney, Agent, or Firm*—John F. McClellan, Sr.

[57] ABSTRACT

A holder permits a conventional nail clipper to be operated with only a downward press of one finger or one toe, with the hand or foot having the nail to be cut resting on a common surface with the holder; a toenail can be cut without need to sit or to bend over if such would help a sufferer with arthritis or would speed up the nail cutting process, the clipper butt end instantly slips into a socket in the block-like base of the holder, and is as quickly removed; a portion of the clipper with the jaws protrudes upwardly and forwardly beyond the holder and the socket has an incline downwardly toward the rear that tips the jaws upward for safe visibility and for increasing the securance of the clipper in the socket under pressure of nail cutting.

7 Claims, 4 Drawing Figures

NAIL CLIPPER HOLDER

FIELD OF THE INVENTION

This invention relates generally to supports and specifically to an improved holder for fingernail and toenail clippers.

SUMMARY OF THE INVENTION

This invention provides a nail clipper support system which permits the user to clip fingernails and toenails by simple downward pressure of a finger or toe.

In the prior art various U.S. patents have disclosed devices related to aspects of the field of this invention, including the following:

U.S. Pat. No. 2,467,589 issued to G. E. Johannson on Apr. 18, 1949, disclosed a nail cutter mounted inside a box, into which the nail is extended;

U.S Pat. No. 3,180,025 issued to Y. Tsunemi on Apr. 27, 1965, disclosed a hinged casing that can attach to a nail clipper and is relatively broad; however this casing has a protrusion 11 in the lower face that would prevent it from resting in flat and stable relation on a surface such as a table and a low elevation that would render the cutting jaws of the clipper relatively inaccessible while on a table;

U.S. Pat. No. 3,855,698 issued to K. R. Crosby on Dec. 24, 1974, disclosed a nail clipper within a housing but with the clipping end substantially concealed and with a height if laid on a table, rendering the clipping end substantially inaccessible;

U.S. Pat. No. 3,903,596 issued to K. R. Crosby on Sept. 9, 1975 disclosed another form of enclosed clipper, this one of a special or unconventional design, with the clipping end relatively inaccessible and the height of the clipping end too low to permit operation while the case rests on a table;

U.S. Pat. No. 3,943,948 issued to J. A. Satore on Mar. 16, 1976 disclosed a conventional clipper in a casing, the casing having a pivoted lid which evidently would be unstable as a base set on a table; the height of the clipper is evidently too low for operation resting on a table, and the clipping end is relatively inaccessible.

However, no known device provided the advantages of the present system according to the objects thereof, which include:

to provide a system as described that requires no other support for operation of a conventional nipper type nail clipper than a unitary box that the nail cutter drops into and that holds in position the clipper for operation by a simple push to clip either a fingernail or a toenail, with good, safe, visual and physical access;

to provide a system as described that permits operation by push of a toe so that toenails can be cut with no bending required;

to provide a system as described which is size adaptable in construction to fit either fingernail clippers or toenail clippers;

to provide a system as described that is low in cost to make, sell and purchase, is as easy to use with left hand or foot as it is with right hand or foot, that requires no cleaning and can be quickly set up, or knocked down for storage, that is quiet in operation and that is durable and attractive in appearance, and to provide a system as described which is particularly well adapted for use by arthritics and others who find bending difficult or impossible but who can trim toenails while sitting upright or even standing, using this invention.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
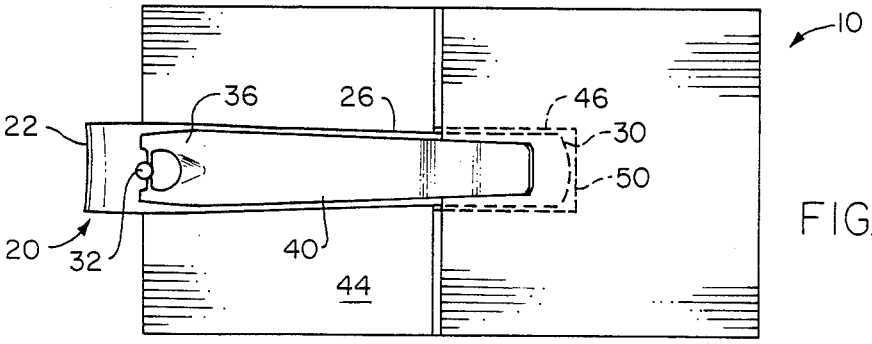
FIG. 1 is a plan view of a first embodiment of the invention holding a conventional nail clipper.
Figure 2:
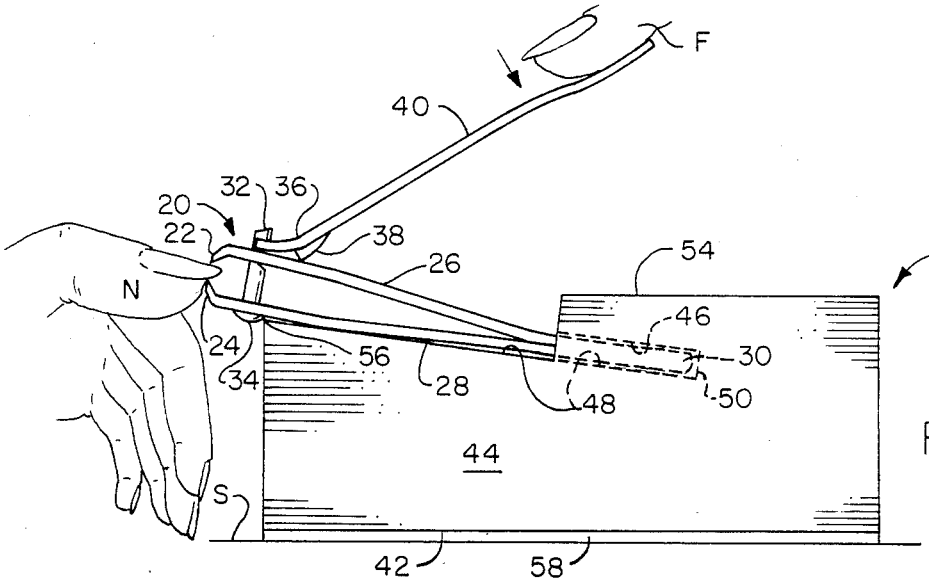
FIG. 2 is a side elevational view of the first embodiment of the invention holding a conventional nail clipper.

FIGS. 1 and 2 show the invention in embodiment 10, holding a conventional nail clipper 20 made from three pieces of flat stock and a fastener. The nail clipper is of the type having an elongate cutting head of spring-tempered metal. At the first or front end upper jaw 22 and lower jaw 24 cutting edges are in spaced opposition in a vertical plane, and have respective substantially transverse to them substantially congruous rearward extensions 26, 28 which are joined as end portions flat together in a butt 30 at the second end of the cutting head. The jaws are sprung apart becuase they are slightly at an angle to each other, and means is provided to force them together in cutting, in the form of a member 32 such as a rivet affixed to the lower jaw as by a protrusive head 34 on the underside and extending upwardly through both jaws where it is pivotally engaged by the bent end 36 of a handle portion that lies on the upper surface of the upper jaw rearward extension, either with or without an integral fulcrum protrusion 38. The reminder of the handle 40 extends upwardly towards the rear at about a 45° angle. Ordinarily such a clipper is manually held and to cut, the handle is squeezed toward the butt after being located with a jaw on either face of a fingernail or toenail.

In The system of the present invention, however, the handle 40 can simply be pressed down with one finger F, and the finger or toe having the fingernail or toenail N to be cut can be rested on the floor S or table or other surface supporting the bottom portion 42 of base 44 of the holder.

The nail clipper 20 is instantly secured in the holder 10 by one motion of the hand of a user or removed from it, by simply slipping the butt 30 of the clipper into or out of socket 46 in the base. The socket freely receives and fits the thickness of the butt and also the width. The harder the handle is pressed (arrow) the more securely the butt 30 is held. Because the base has an incline 48 downwardly towards the rear or second end, and the incline continues into the socket as the floor portion, pressure for forcing the jaws together tends to force the end of the butt against the socket end wall 50; the separation shown is for exposition, preferably they are in contact. The incline may be about 7 to 10 degrees. The rivet head 34 may engage the front edge of the base and serve to stop rearward motion, if desired.

Projection of the nail clipper ahead of the base should be at least one-half inch (13 mm).

It will be appreciated that although the rearward extensions of the jaws spring together and apart, the butt does not, and this and the underlying support by the inclined top portion co-act to prevent shifting.

Upward incline of the front end of the nail clipper is also a means for providing safe, good visibility of the cutting edges on nail insertion and during cutting, regardless of whether the nail being clipped is on a hand or foot resting on the same supporting surface as the holder, or is on a book or other support for adjustment and comfort.

The base 44 is substantially rectangular, and may be about 2¼ inches by 4 inches (5.5 by 11 cm) in plane with a flat top 54 or ledge portion at the rear which is about 1 9/16 (4 cm) high, a front edge 56 about 1 7/16 inch (3.5 cm) high, and a socket depth of 11/16 inch (2.5 cm) as measured into the ledge portion.

The base may be simply a solid block of wood, or may be of hollow thermoplastic, in either case very economical. It preferably has a non-skid or cushioning bottom pad 58 of rubber or felt.

Figure 3:
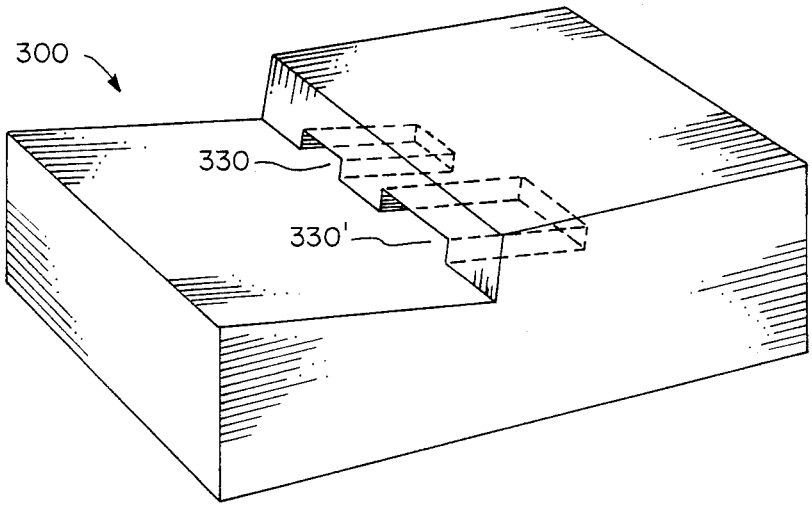
FIG. 3 is a perspective view of a second embodiment of the invention.

FIG. 3 shows embodiment 300 that may be like the first embodiment except that it may hold different-size clippers, fingernail and toenail sizes respectively, in sockets 330 and 330'. If desired, the two (or more) clipper sizes can be held in individual holders.

Figure 4:
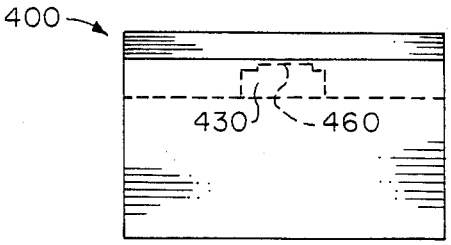
FIG. 4 is a front-end elevational view of a third embodiment of the invention.

FIG. 4 shows that in an embodiment, such as 400 shown, the file that is customarily supplied on the upper portion of the upper jaw rearward extension with some nail clippers of the type, can be accommodated in an upward clearance 460 in the slot 430.

This invention is not to be constructed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system for cutting fingernails and toenails by means of a conventional clipper of the type having:

an elongate cutting head with first and second ends, an upper jaw and a lower jaw with respective cutting edges spacedly opposed in a vertical plane on the first end, substantially congruous respective rearward extensions of the upper jaw and lower jaw, substantially transverse to the upper jaw and lower jaw, means at the second end joining together as a butt a portion of the length of said rearward extensions, means adjacent the first end for forcing the upper and lower jaws together, including a member fixed to the lower jaw and protruding upward through a hole in the upper jaw, a lever with a handle for pressing, the handle having a free end protrusive upwardly at an angle from a bent end of the handle resting on the upper jaw rearward extension, said bent end pivotally engaging said member, means for holding the clipper, and said means for holding having a portion for resting on a supporting surface, the improvement comprising in combination with said clipper:

said means for holding being unitary and including: a base, means for securing instantly the clipper to or removing the clipper from the base with one motion of a user's hand, the means for securing, securing the clipper with said upper and lower jaws of the clipper projecting free of the base in position for clipping nails, with the free end of the handle upward, said position for clipping nails being with said upper and lower jaws upwardly inclined to a height above the portion for resting on a supporting surface permitting a toenail to be inserted between the jaws by a nominal size foot resting, with said portion for resting, on a said supporting surface; said means for securing including structure of the base defining a socket freely receiving said butt and having an incline at an angle downwardly towards said second end, means for preventing said clipper from shifting in said socket, comprising said structure of the base that defines a socket laterally fitting said butt, and said means for preventing said clipper from shifting further including a part of the base extending beyond the socket and underlying the rearward extension of the lower jaw.

2. In a system as recited in claim, 1, said part underlying the rearward extension further extending to said butt.

3. In a system as recited in claim, 1, said base being substantially rectangular with a top portion having a second said socket therein.

4. In a system as recited in claim 1, said structure of the base that defines a socket being in a ledge portion of said base.

5. In a system as recited in claim 1, said base being a solid.

6. In a system as recited in claim 1, said base being a block of wood.

7. In a system as recited in claim 1, said base being a hollow body of thermoplastic material.

* * * * *